US005172748A

United States Patent [19]

Satmer

[11] Patent Number: 5,172,748

[45] Date of Patent: Dec. 22, 1992

[54] DEVICE FOR THE BATCH-WISE PREPARATION OF LOOSE MATERIAL

[75] Inventor: Franz Satmer, Schaffhausen, Switzerland

[73] Assignee: Georg Fischer AG, Schaffhausen, Switzerland

[21] Appl. No.: 621,806

[22] Filed: Dec. 4, 1990

[30] Foreign Application Priority Data

Dec. 6, 1989 [CH] Switzerland ..... 04390/89-6

[51] Int. Cl.[5] ..... B22C 5/02

[52] U.S. Cl. ..... 164/412; 164/5; 241/73; 241/197; 241/DIG. 10

[58] Field of Search ..... 164/5, 412; 241/195, 241/197, 199.12, DIG. 10, 73, 74

[56] References Cited

U.S. PATENT DOCUMENTS

| | | | |
|---|---|---|---|
| 28,960 | 7/1860 | Boulger | 241/195 |
| 1,402,199 | 1/1922 | Williams | 241/195 |
| 2,763,439 | 9/1956 | Mankoff | 241/197 |

FOREIGN PATENT DOCUMENTS

| | | | |
|---|---|---|---|
| 248208 | 7/1966 | Austria | 241/199.12 |
| 394839 | 5/1924 | Fed. Rep. of Germany | 241/73 |
| 2909408 | 10/1979 | Fed. Rep. of Germany | 164/5 |
| 3212762 | 3/1983 | Fed. Rep. of Germany | 241/195 |
| 3436803 | 4/1983 | Fed. Rep. of Germany | 241/197 |

*Primary Examiner*—Richard K. Seidel
*Attorney, Agent, or Firm*—Bachman & LaPointe

[57] ABSTRACT

An impact rotor arranged concentrically to the axis of a drum has preferably four beating blades which are wave-shaped on the outer peripheral side.

8 Claims, 1 Drawing Sheet

DEVICE FOR THE BATCH-WISE PREPARATION OF LOOSE MATERIAL

BACKGROUND OF THE INVENTION

The present invention relates to a device for the batch-wise preparation of loose material and more particularly, a device comprising a horizontally arranged drum and an impact rotor concentric to the drum axis provided with beating blades.

A device as aforesaid is known from DE-C2-29 09 408 in which the impact rotor has beating blades with a straight outer peripheral side. Beating blades of this type are of simple construction but their abrasive effect and hence also the regeneration effect of old sand is unsatisfactory.

It is the object of the present invention to produce a device of the above-mentioned type whose impact rotor is constructed so that it has the best possible abrasive effect with a low power consumption for the rotor drive.

SUMMARY OF THE INVENTION

The foregoing object is achieved by way of the present invention wherein the beating blades of the impact rotor are wave-shaped on the outer peripheral surface.

Through calculations and experiments, it has been determined that by providing a wave-shaped outer peripheral surface on the beating blades of the impact rotor a substantially better abrasive effect is achieved on the loose material to be prepared and that the power consumption for the impact rotor is also reduced. These wave-shaped beating blades cause a constantly alternating compression and relaxation of the filling density between the drum wall and the rotor circumference and a great increase in turbulences in the loose material is achieved. In addition, because the particles are centrifuged against each other with more force, there is a better abrasive effect.

Furthermore, it was found that there was a more uniform and, at the same time, smaller amount of wear on the abrasive blades so that their service life was extended.

BRIEF DESCRIPTION OF THE DRAWINGS

The invention is represented and described below by means of the enclosed drawings, in which.

DETAILED DESCRIPTION

Figure 1:
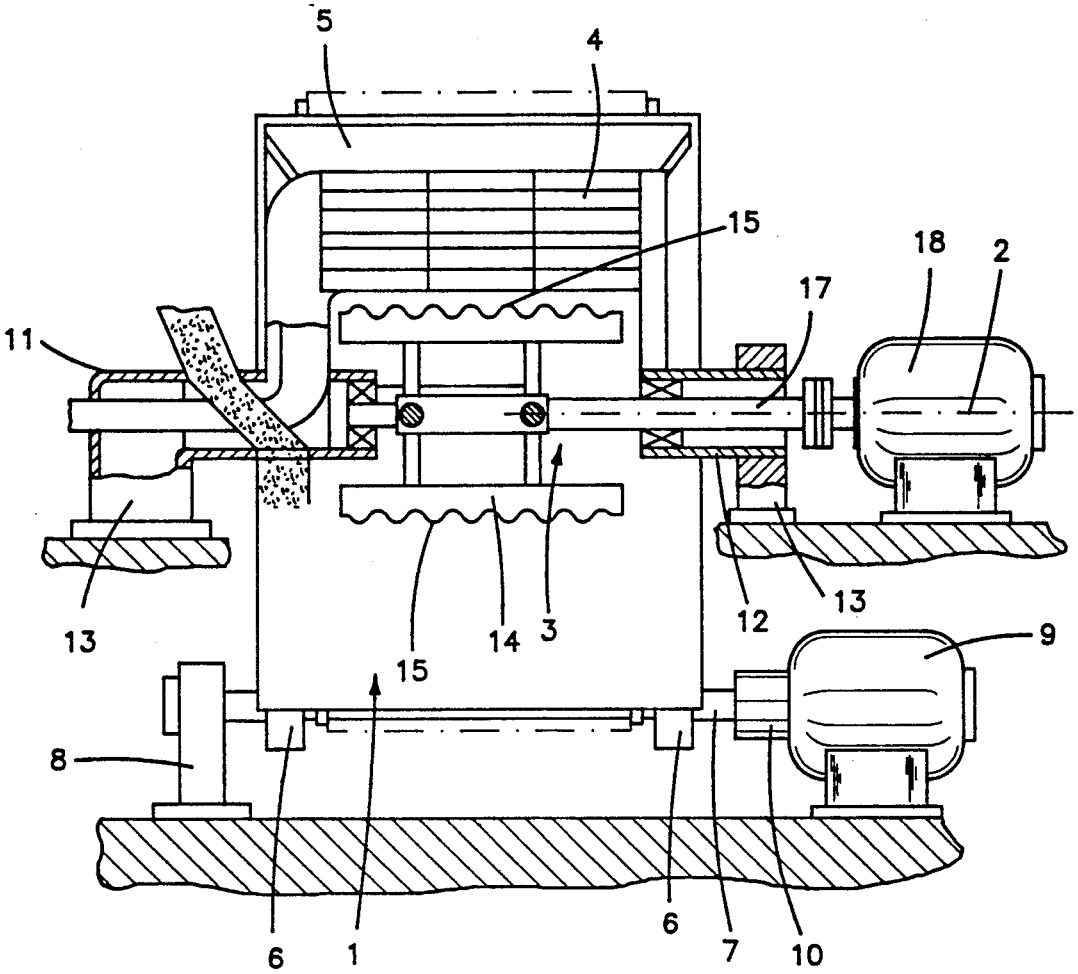
FIG. 1 is a longitudinal section of the device along the drum axis.

The illustrated batch-type device for the treatment of loose material, in particular foundry sands, essentially comprises a drum 1 rotating about a horizontal axis 2, an impact rotor 3, a suction device 4 and a stripper 5 arranged thereon. The drum 1 rests on drive rollers 6 and their shafts 7 are guided in bearing blocks 8. One of the shafts 7 is driven by a motor 9 via a reduction gear 10. Coaxially to the drum axis 2 are two fixed, tubular holding elements 11, 12 arranged in pedestals 13 on either side of the drum 1.

In the two holding elements 11, 12 a shaft 17 is mounted and is driven at relatively high speed by a motor 18. The shaft 17 carries the impact rotor 3 inside the drum 2.

The impact rotor 3 has at least two, preferably four, beating blades 14 whose outer peripheral side (surface) 15 is wave-shaped.

Figure 2:
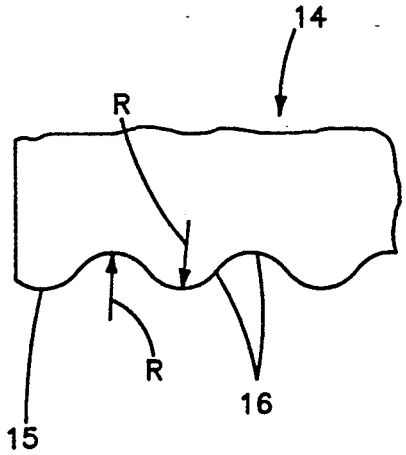
FIG. 2 is an enlarged partial plan view of a beating blade of the impact rotor.

Advantageously, the wave-shaped peripheral side 15 is, according to FIG. 2, formed from respectively alternating concave and convexly arranged quarter arcs 16 which have the same radii R. The peripheral side 15 can also be constructed in the shape of a sine curve.

The beating blade 14 can be made from a cast iron material in a casting process or from a steel plate by a material-removing or cutting process. Wear-resistant materials such as chilled cast iron, alloyed cast steel or alloyed steel or even a wear-resistant spheroidal graphite cast, are preferably used for making the beating blades.

There is also the possibility of making wear-resistant at least those parts of the beating blade exposed to great wear, by coating or welding a wear-resistant material such as hard steel, sintered material, ceramics, oxide ceramics or the like to the blades.

The wear layers or parts can also be produced by adhesion, sintering or compound casting.

The beating blades 14 are preferably connected to the impact rotor 3 in an easily exchangeable manner, such as, by means of screws or a clamp connection.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. In a foundry apparatus, a device for the batch-wise preparation of loose molding material having a horizontally arranged drum and an impact rotor rotating concentrically to the drum axis on a shaft wherein the impact rotor has at least two beating blades, the improvement which comprises each beating blade is fixed to said impact rotor and non-moveable relative thereto and is provided with a wave-shaped surface on the outer peripheral side thereof.

2. A device according to claim 1 wherein the wave-shaped peripheral side is formed from arcs of a circle arranged respectively alternately concave and convex.

3. A device according to claim 1 wherein the outer peripheral side is constructed in the form of a sine curve.

4. A device according to claim 1 wherein the beating blade is made of a cast iron material in a casting process.

5. A device according to claim 4 wherein the whole beating blade is made of a wear-resistant material selected from the group consisting of chilled cast iron, alloyed steel or cast steel.

6. A device according to claim 4 wherein the parts of the beating blade exposed to wear are covered with a wear-resistant material.

7. A device according to claim 1 wherein the beating blade is made of a steel plate.

8. A device according to claim 1 wherein the beating blades are secured on the impact rotor in an exchangeable manner.

* * * * *